US006569690B1

(12) United States Patent
Houge et al.

(10) Patent No.: US 6,569,690 B1
(45) Date of Patent: May 27, 2003

(54) MONITORING SYSTEM FOR DETERMINING PROGRESS IN A FABRICATION ACTIVITY

(75) Inventors: Erik Cho Houge, Orlando, FL (US); Isik C. Kizilyalli, Millburn, NJ (US); John Martin McIntosh, Orlando, FL (US); Fred Anthony Stevie, Orlando, FL (US); Catherine Vartuli, Windermere, FL (US)

(73) Assignee: Agere Systems Guardian Corp, Orlando, FL (US)

( * ) Notice: Subject to any disclaimer, the term of this patent is extended or adjusted under 35 U.S.C. 154(b) by 0 days.

(21) Appl. No.: 09/653,364

(22) Filed: Aug. 31, 2000

(51) Int. Cl.[7] ..... H01L 21/00

(52) U.S. Cl. ..... 438/8; 216/38; 216/88; 216/84; 438/692; 438/745

(58) Field of Search ..... 438/8, 9, 14, 691, 438/692, 693, 745, 753; 156/345 LC, 345 LP; 216/38, 88, 89, 84

(56) References Cited

U.S. PATENT DOCUMENTS 5,705,435 A * 1/1998 Chen ..... 438/8
5,838,448 A * 11/1998 Aiyer et al. ..... 216/84 X
5,972,787 A * 10/1999 Boggs et al. ..... 216/84 X

* cited by examiner

*Primary Examiner*—William A. Powell
(74) *Attorney, Agent, or Firm*—Ferdinand M. Romano

(57) ABSTRACT

Method for fabricating a structure. According to an exemplary embodiment, a structure is made by forming a layer of removable material with a first surface spaced a part from a second surface. The first surface is formed along a first region from which the material is removable. The first surface is altered by removal of material from the layer. Removed material from the first surface is monitored to detect fluctuations in a variable of composition in the layer, and removal of material from the first surface is terminated when the composition of monitored material meets a predetermined criterion. In an alternate embodiment a variable characteristic is imparted to a layer of material as a function of layer thickness and an operation is performed on the layer resulting in removal of material. Samples of removed material are monitored for variation in the characteristic and the operation is modified when a variation conforms with a criterion.

9 Claims, 6 Drawing Sheets

MONITORING SYSTEM FOR DETERMINING PROGRESS IN A FABRICATION ACTIVITY

FIELD OF THE INVENTION

This invention relates to fabrication operations and, more specifically, to a system and a method for monitoring progress during fabrication of a part.

BACKGROUND

Fabrication of components often involves removal of material in order to create a feature or reduce a dimension. By way of example, both microelectronic machining and semiconductor device fabrication involve formation of layers of material followed by operations which then remove the material to create vias or planarize a surface. Frequently these fabrication steps are performed chemically or mechanically, and sometimes with the assistance of charged particles such as a plasma or ion beam. Common examples in semiconductor processing include etching of openings such as contact vias and isolation trenches. Also, layers may be thinned by chemical mechanical polishing (CMP) of surfaces to remove material, e.g., material deposited to fill a via, until a surface of one material composition is along the same plane as an adjoining surface of different composition.

Frequently, in these and many other types of fabrication steps material is removed from a surface region to a critical depth which should not be exceeded. However, the ability to directly measure progress of the activity may be difficult or cost prohibitive. For example, while it may be desirable to perform direct measurement of such progress, the fabrication activity may have to be stopped in order to obtain the measurement. Because many contemporary manufacturing operations are capital intensive it is undesirable to reduce throughput by temporary removal of a work piece from an operation in order to perform such measurement. On the other hand, when there is no alternative to removing a work piece from manufacture in order to perform measurement or other analysis, the removal is done on a limited basis (e.g., spot checking) in order to maximize throughput.

During manufacture, the in-line monitoring of product and analysis of process features assures that an operation is providing results within acceptable limits of variability. For example, during fabrication of semiconductor devices, when an opening is being etched through one layer of material to a second layer, it is possible to detect completion of the opening, i.e., end point, by analysis of removed material to identify material of the second layer. The usefulness of such an approach depends on the amount of over etch which can be tolerated. If the etch selectivity is low, the critical depth may be exceeded before end point is detected.

When a process step is well characterized and repeatable it is common to apply the process for a fixed time in order to reach an end point. As the depths of material removal become smaller the margin of error associated with timed operations remains constant such that it becomes more likely that critical depth or end point does not coincide with completion of the timed operation.

In this regard, endpoint detection for CMP operations has been particularly problematic. The two basic methods in use today are the timed operation and a technique of monitoring the change in frictional force associated with the polishing pad and the work piece. The timed technique may be considered largely a trial and error determination.

For CMP operations, changes in frictional force are detectable by measuring the responsive change in motor drive current as the motor turning the polishing pad encounters increased friction. By way of example, when polishing a silicon oxide dielectric layer in a semiconductor product, the friction detection method may incorporate an otherwise unnecessary CMP stop layer such as silicon nitride. As the CMP process initially removes only the silicon oxide, the drive force of the CMP motors remains relatively constant. When the polishing pad comes into contact with the silicon nitride the change in friction is detectable and this signals an opportunity to stop the CMP process before over polish occurs.

The drawback to each of these methods again relates to dimensional tolerances, or the lack of a soft landing at polish stop. Resultant over polishing or under polishing leads to non-uniformity between product wafers in the same lot as well as between wafer lots. Another undesirable effect is consequent damage to alignment marks from over polishing. If the ability to detect the alignment marks is lost, subsequent levels of deposited material cannot be properly processed, resulting in lot scrap or yield loss due to misalignment of features.

SUMMARY OF THE INVENTION

According to an exemplary embodiment of the invention, a method is provided for making a structure by forming a layer of removable material with a first surface spaced a part from a second surface. The first surface is formed along a first region from which the material is removable. The first surface is altered by removal of material from the layer. Removed material from the first surface is monitored to detect fluctuations in composition and removal of material from the first surface is terminated when the composition of monitored material meets a predetermined criterion.

In an alternate embodiment of the method a variable characteristic is imparted to a layer of material as a function of layer thickness and an operation is performed on the layer resulting in removal of material. Samples of removed material are monitored for variation in the characteristic and the operation is modified when a variation conforms with a criterion.

DESCRIPTION OF THE DRAWINGS

Numerous advantages of the invention will be apparent when the following detailed description is read in conjunction with the accompanying drawings, in which.

The drawings are not to scale, but rather, provide schematic representations of a circuit structure to emphasize relevant features relating to the invention. Accordingly, numerous incidental details are not illustrated. For example, deposited layers which may in fact be conformal are not necessarily illustrated as such.

Terminology

Surface portion means a region along the surface of a layer which may be arbitrarily identified or which may be defined based on the geometric shape of the surface or a function associated with the layer. For example, the surface of a sphere may be arbitrarily divided into two hemispheres each being a surface portion, while the surface of wafer may be divided into three surface portions consisting of first and second opposing surfaces and an edge surface connecting the opposing surfaces.

DETAILED DESCRIPTION OF THE INVENTION

Embodiments of the invention now described may be most useful in complex semiconductor structures having relatively thin layers of material formed therein. Such structures will have manufacturing tolerances which are difficult to achieve with conventional end point detection techniques and, when fabricated with Ultra Large Scale Integration processes, e.g., geometries of 0.25 micron or less, will have circuit densities and electrical performance requirements which demand precision tolerances that are critically dependent upon accurate and timely end point detection.

Application of the invention is illustrated for removal of dielectric material by chemical mechanical polishing. For this example it is convenient and advantageous to vary the composition of the dielectric material with isotopic variants of the dielectric chemistry in order to determine progress of the polishing activity to end point. In other applications it may be more advantageous to modify the material being removed with other variants such as elements and chemical variants which do not adversely affect the fabrication or operation of the product, including embedded markers which are detectable by means other than the various forms of spectroscopy.

Figure 1:
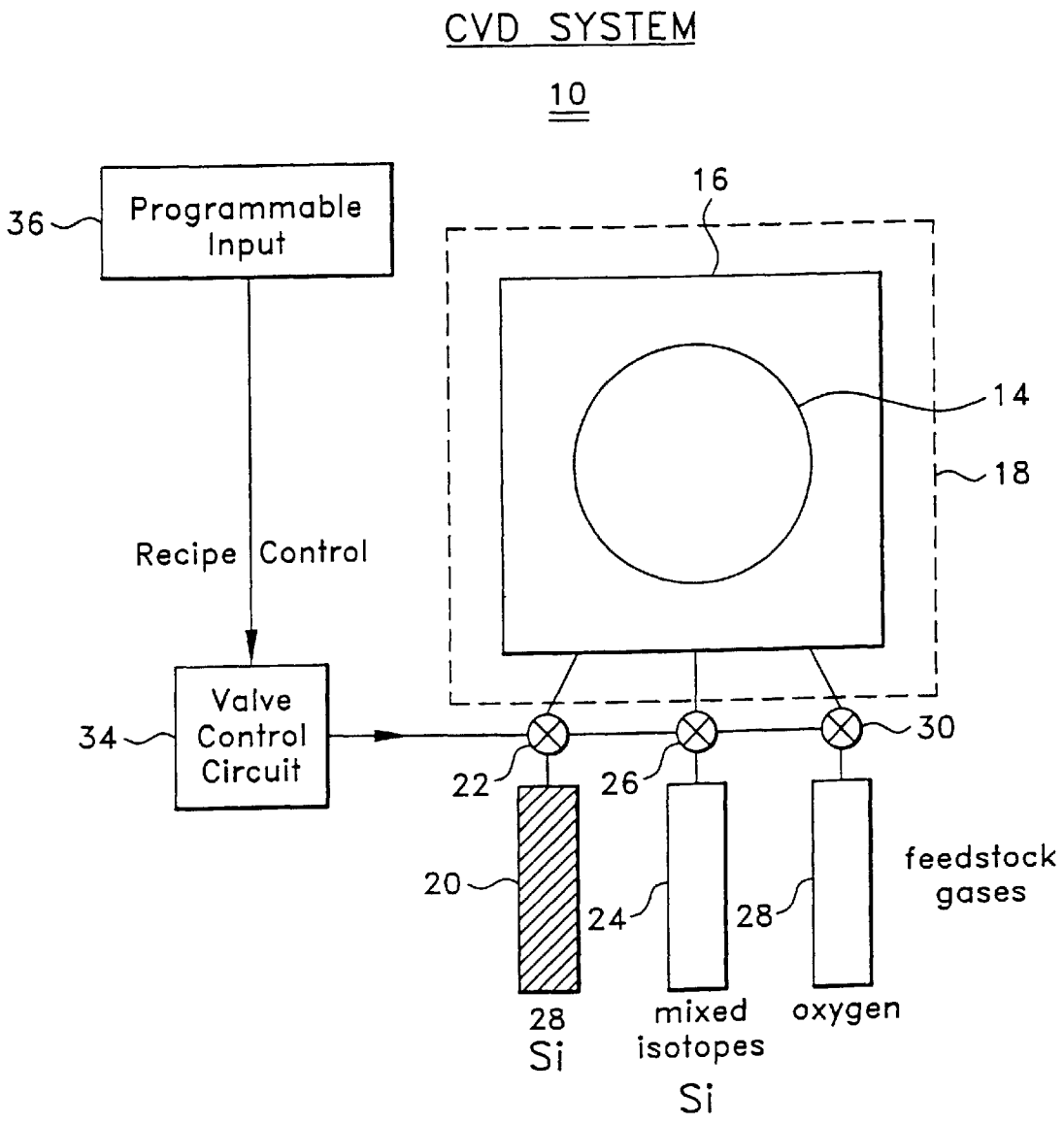
FIG. 1 illustrates, for an example embodiment of the invention, a system for depositing a layer of material.

With reference to FIG. 1 there is shown in part a schematic representation of a chemical vapor deposition (CVD) system 10 useful for depositing a layer of material on a substrate. In the following example the system controllably reacts multiple isotopic variations of silane with oxygen to deposit a layer of silicon oxide on a semiconductor wafer 14. The wafer 14 is positioned on a support 16 in a deposition chamber 18. Three feedstock gas sources are shown. A supply 20 of silane formed with $^{28}$Si is available to the chamber 18 through control valve 22. The $^{28}$Si of supply 20 has an isotopic purity greater than 99 percent. Such material is commercially available from Isonics corporation of Golden Colorado. A supply 24 of silane formed with naturally occurring silicon (approximately 92 percent $^{28}$Si, 5 percent $^{29}$Si and 3 percent $^{30}$Si) is available to the chamber 18 through control valve 26. A supply 28 of oxygen is available to the chamber 18 through control valve 30. The composition of gases inserted through the valves 22, 26 and 30 is varied by a control circuit 34 according to a programmable input 36. The reaction is performed under conventional process conditions. A profile of the deposited dielectric film follows the variation in isotopic composition of the inserted gases.

Figure 2:
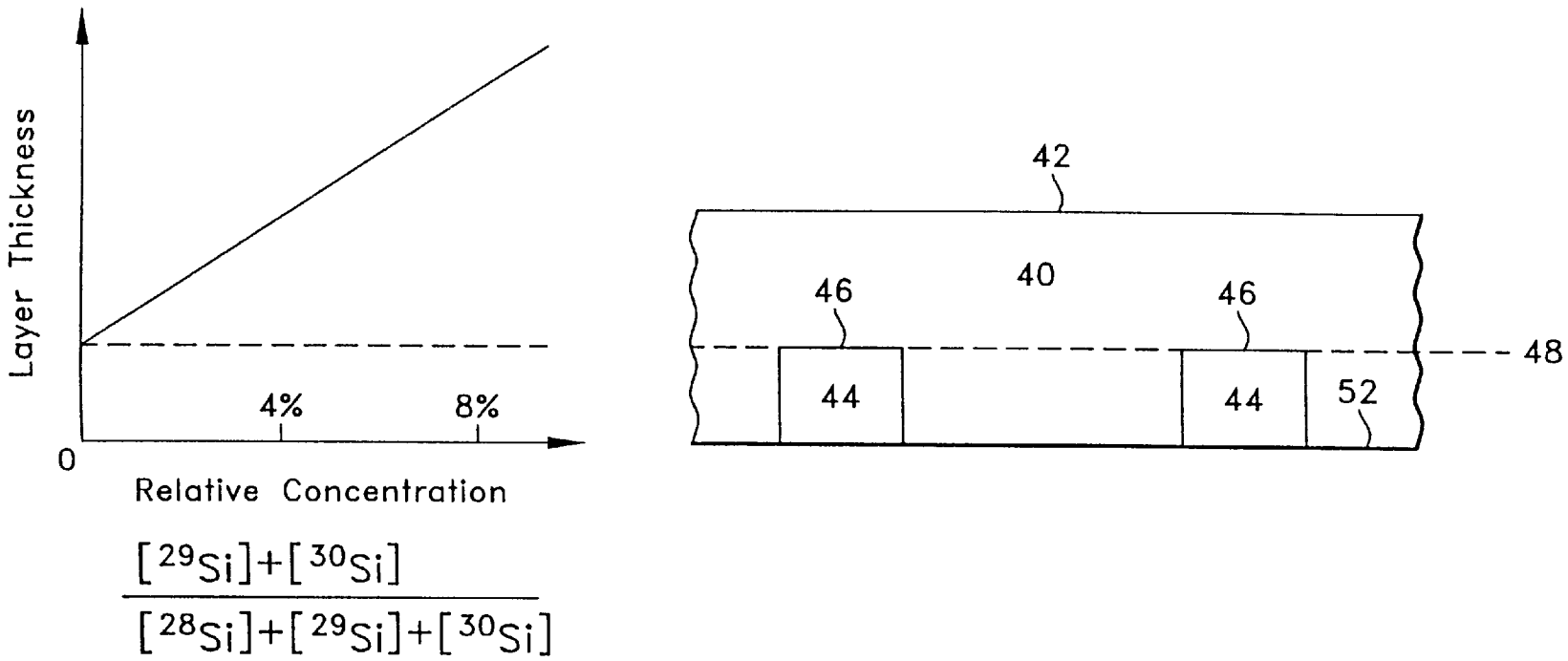
FIG. 2 illustrates a layer of material deposited according to an embodiment of the invention.

FIG. 2 illustrates in cross section a portion of a partially fabricated semiconductor device 40 of the wafer 14. A layer 40 of dielectric material has been deposited on the device by the CVD system 10 to achieve an isotopic variation of Si concentration. For simplicity of illustration active semiconductor regions and other features common to such devices are not illustrated. Yet it is to be understood that the dielectric layer 40 may be one of many layers in a metallization system having alternate depositions of insulator and conductor metal. Such layers are configured through lithography and etch processing to provide a multiple metallization levels of an interconnect system in support of device circuit functions.

Figure 3:
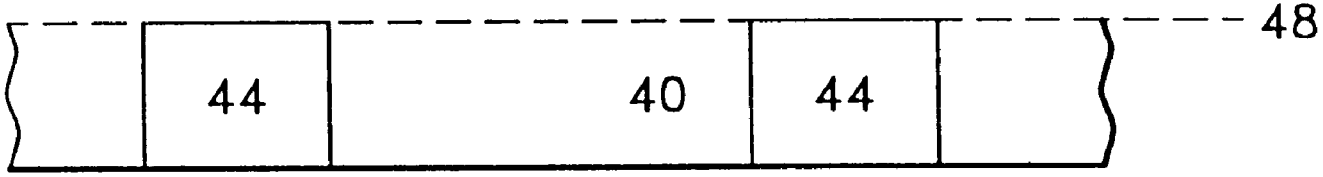
FIG. 3 illustrates the layer of FIG. 2 after polishing.

In FIG. 2 the layer 40 is shown to have been deposited over a metallization level comprising exemplary conductors 44 having upper surfaces 46 along a plane indicated by a reference line 48. Other metallization levels may have been formed below the conductors 44 according to the invention; and, according to the invention, still other metallization levels may be formed over the dielectric layer 40 after the layer 40 is polished down to the plane 48. The layer 40 has an initial surface 42 prior to polishing. The insulative layer could also be deposited directly over a semiconductor layer, in which case the polishing operation would planarize the layer after formation of trench isolation regions. FIG. 3 illustrates the layer 40 polished to the plane 48.

To determine the end point for polishing the layer 40 to the plane 48 the layer 40 includes an isotope mix such as illustrated in the graph of FIG. 2 wherein the axis labeled "Layer Thickness" is relative to the lower surface 52 of the layer 40. As illustrated in the graph, the silicon oxide dielectric layer 40 comprises a variable concentration of $^{28}$Si. This is effected by initially injecting 100 percent $^{28}$Si silane from supply 20 until the deposited dielectric material reaches the plane 48, at which time silane may be introduced from the supply 24 in combination with silane from the supply 20. In this example, the proportion of silane injected to the chamber from each of the supplies 20 and 24 is modified in a linear manner as silicon oxide is deposited so that at some point near the end of the deposition all of the silane is injected from the supply 24. In this example, at the end of the deposition, the concentration of $^{28}$Si has decreased from 100 percent to 92 percent, and the combined concentration, [$^{29}$Si]+[$^{30}$Si], has risen to eight percent of the total silicon concentration.

Generally, any variable characteristic may be imparted to the layer 40 as the layer is deposited so that a depth profile (i.e., a profile taken in a vertical direction relative to the plane of deposition) is encoded with variations which are detectable during the process of removing material. For example, a digital signal may be embedded in the depth profile by abruptly varying the injected supplies from 100 percent supply 20 to 100 percent supply 24. The pulse trains may be of variable durations and spacings to further identify distance from end point. Such signals may be used to modify the polishing rate, e.g., by changing the rpm of the CMP machine or by altering the slurry composition.

Figure 4:
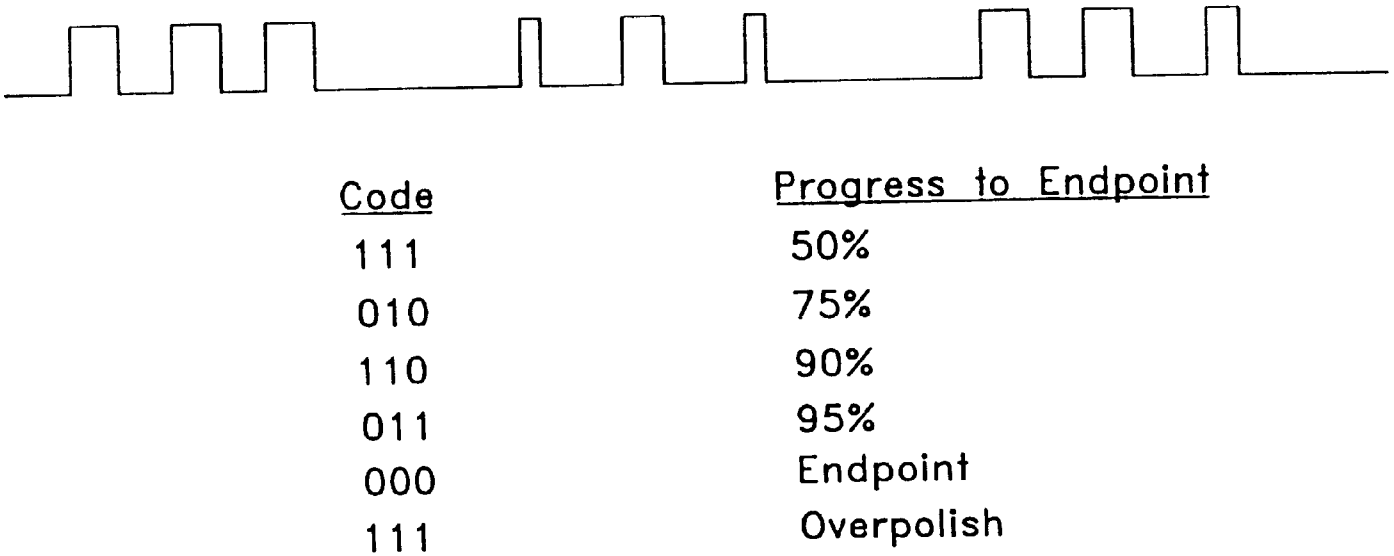
FIG. 4 illustrates an exemplary coding sequence.

See, for example, FIG. 4 which illustrates a digital encoding in the deposited layer 40 by discretely altering the composition (i.e., in a square wave fashion) from one silane supply 20 to the other silane supply 22. Relatively short pulses of supply 24 may correspond to a digital "1" while the relatively long pulses from supply 24 may correspond to a digital "0". Other forms of digital encryption, such as the binary code, also illustrated in FIG. 4, may be used to indicate progress to endpoint.

Figure 5:
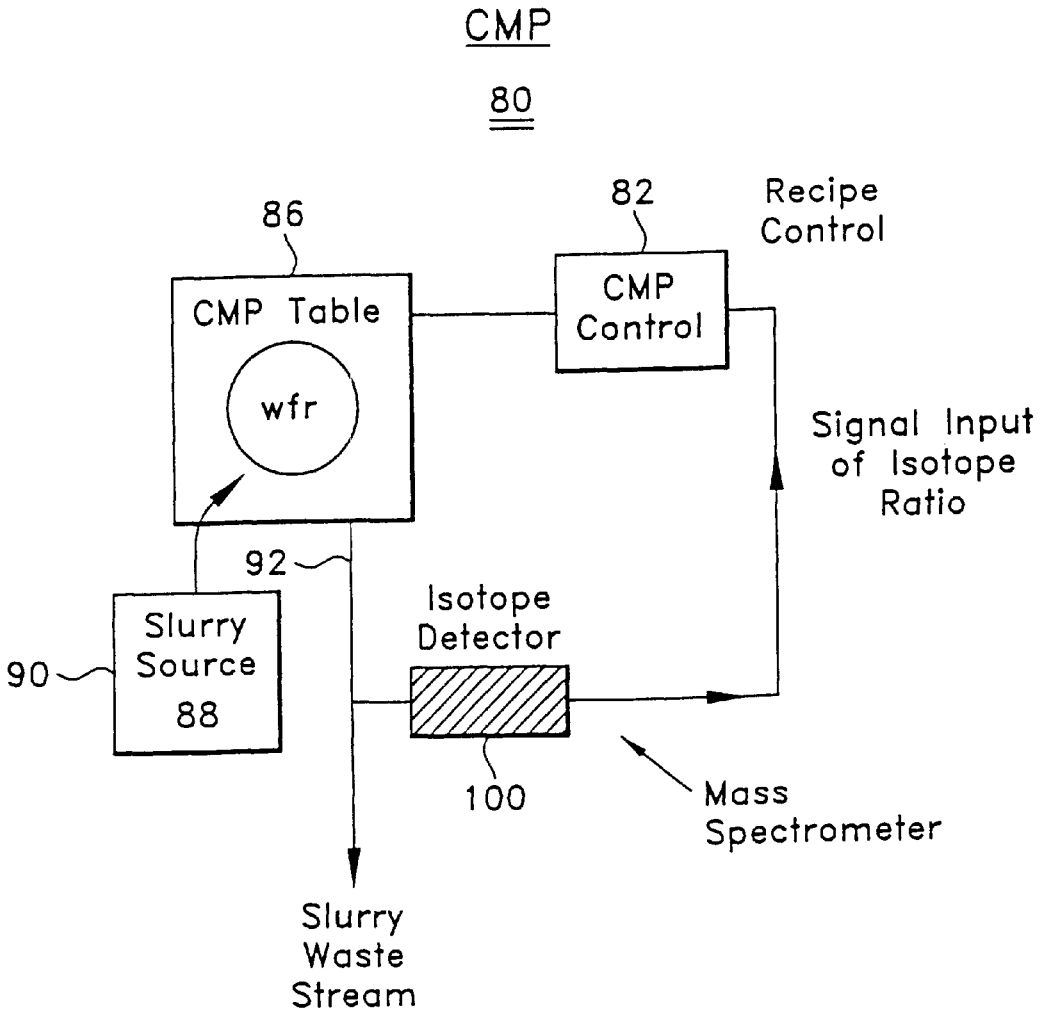
FIG. 5 illustrates a polishing system according to one embodiment of the invention.

Once the layer 40 is deposited with a desired encryption, it is polished on a CMP system 80 such as schematically shown in FIG. 5. A controller 82 directs motorized movement on the CMP table 86 to remove material of the dielectric layer 40 as slurry 88 is piped to the table from a source 90. Used slurry exits the table through a waste stream line 92. A portion of the used slurry is diverted to an isotope detector 100 which provides a signal to the controller 82 indicative of the proportion of Si isotopes detected in the slurry during sequential analyses. Preferably the isotope detector is a mass spectrometer.

The slurry 88, containing mixed isotopes, is sampled from the waste stream line 92, e.g., in the volume of one to two cubic centimeters. The liquid suspension is volatized at high temperature and analyzed to determine the Si isotope ratio, e.g., by inductively coupled plasma mass spectrometry.

With the isotopes positioned as markers, the controller is programmed to respond to predetermined signals generated by the isotope detector 100 in response to the markers. For the signal shown in the graph of FIG. 2, the controller responds to detection of a maximum concentration $^{28}Si$ by terminating the polishing activity. Summarily, detection of the proportion of Si isotope markers relative to background serves as a means for linking the controlled deposition of isotope variations with the depth, e.g., relative to the plane 48, at which the CMP system is removing material. A logic system embedded in the controller 82 is capable of modifying CMP parameters for removal rate as end point is approached.

The result is a well-controlled process wherein there is a measurable delay between the time isotope is incorporated into the slurry and when the isotope is analyzed. With the simple pattern shown in the graph of FIG. 2, over-polishing may result from this delay. However, a more detailed encoding, such as one which provides a signal in advance of end point in order to retard the polishing rate, will overcome such concerns. For example, according to the code of FIG. 4, isotopic variations may be modulated with the deposition system of FIG. 1 to provide pulses which vary in duration. A variety of pulse trains are created as markers, indicating, for example, percentage of polishing which remains before end point is reached.

Following the completion of a CMP process the slurry waste stream may be flushed to remove residue traces of the removed CVD material and to reset the normal background Si isotope ratio of the slurry mix in preparation for the next run. Any combination of flows could be used to form any concentration variation in the Si isotope forming the CVD dielectric. Linear, binary or stepped transitions are possible. If a system is developed wherein the slurry can be re-used, the slurry mixture will develop an increasing background level of the isotope selected as the marker. So long as the signal to noise ratio between selected isotope combinations is sufficient, end point markers may continue to be monitored with the same slurry.

Placement and monitoring of isotopic markers for end point detection may require calibration. That is, the position of markers relative to end point should be known with sufficient precision to identify end point within acceptable tolerances. This may be effected by simultaneously monitoring removal of isotopic markers with the system 80 and monitoring end point with suitable detection equipment, an ellipsometer.

Figure 6:
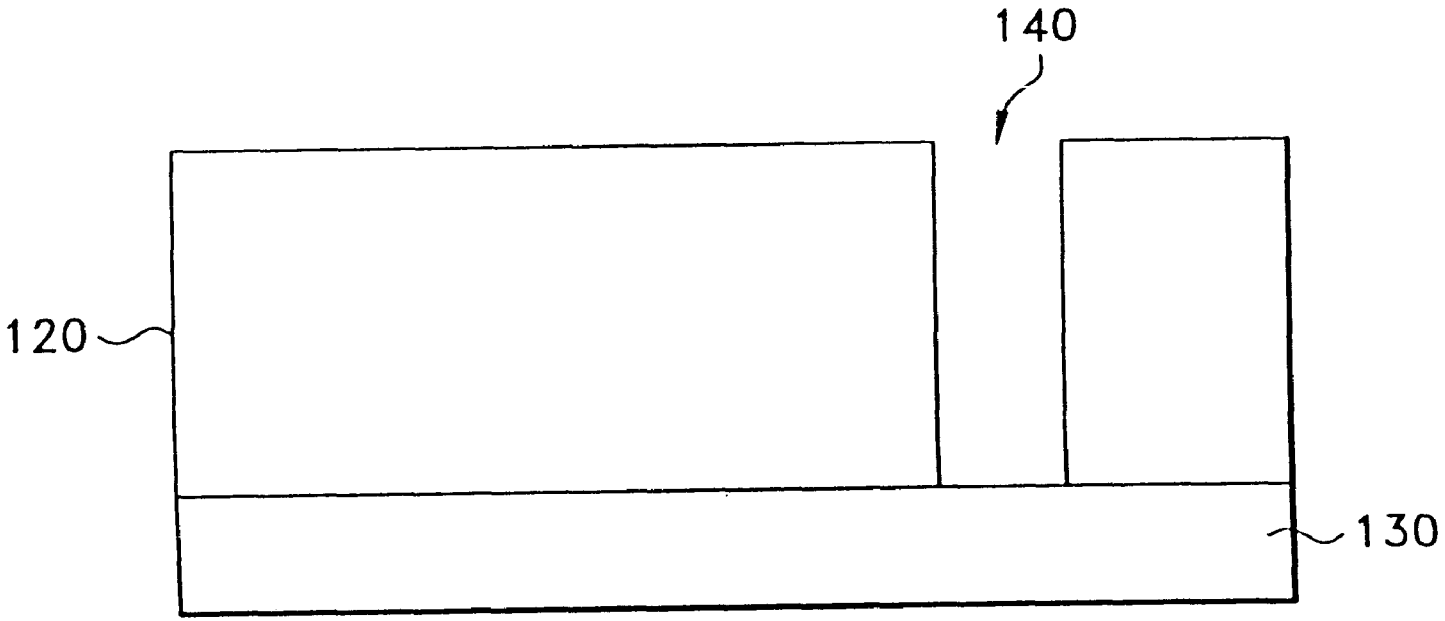
FIG. 6 illustrates a via formed according to an alternate embodiment of the invention.

The concepts disclosed may, more generally, be applied to removal of materials during a fabrication process. For example, with reference to FIG. 6, a layer of insulative material 120 is shown to be deposited over a metal runner 130 of an interconnect system. A via 140 is formed through the insulative layer 120 in order to provide a contact between the runner 130 and a yet-to-be-formed metal runner in a overlying level of metallization. With provision of isotopic markers in the dielectric layer 120, end point in the etch of the via 140 may be detected with analysis of material removed from the layer 120 with a mass spectrometer. Stable isotopes of other elements, e.g., oxygen, may be used as markers in lieu of silicon isotopes. In another application, the isotopic markers may be placed in silicon semiconductor material to monitor removal of silicon during processes such as formation of trenches. It is also contemplated that in numerous applications inert chemicals may be used in lieu of isotopes as markers. This will be useful in processes which require removal of a first layer which is formed over a second layer by an etch process, wherein the etch selectivity between the first and second layer is relatively poor. Use of isotopic markers in such a process will help avoid over etching. This is useful when etching layers formed on semiconductor material that may be easily damaged or over-etched to the point of removing dopant impurities.

With regard to semiconductor fabrication, markers of the type suggested may be used for end point detection in a variety of removal techniques, including the varied forms of etching, e.g., isotopic and anistotropic etching, plamsa etching and ion milling. More generally, the method may be applied to a wide variety of removal processes in other industries, including abrasive removal, milling, sawing and other forms of cutting and shaping.

What is claimed is:

1. A method for making a structure, comprising:

forming a layer of removable material with a first surface spaced apart from a second surface, the first surface formed along a first region from which the material is removable;

altering the first surface by removal of material from the layer;

monitoring material removed from the first surface to detect fluctuations in composition; and terminating removal of material from the first surface when the composition of monitored material meets a criterion.

2. The method of claim 1 wherein the step of monitoring removed material is performed by sequentially analyzing samples of the material for the presence of an isotope.

3. The method of claim 1 wherein the step of altering the first surface displaces the first surface relative to the second surface to reduce the thickness of the layer between the first and second surfaces.

4. The method of claim 3 wherein the removed material is monitored for variations in concentration of an isotope.

5. The method of claim 4 wherein the removal material is monitored for variations in the concentration of an isotope according to a digital sequence.

6. The method of claim 1 wherein the step of forming the layer of removable material is performed by depositing silicon oxide on a semiconductor structure.

7. The method of claim 6 wherein the criterion corresponds to presence of an isotope of Si.

8. Method for manufacturing comprising the steps of:

imparting a variable characteristic to a layer of material as a function of layer thickness;

performing an operation on the layer;

monitoring samples of the material for variation in the characteristic; and modifying the operation when a variation conforms with a criterion.

9. Method of claim 8 wherein the step of modifying the operation terminates the operation when a variation is monitored.

* * * * *